US007278347B1

(12) United States Patent
Scharf et al.

(10) Patent No.: US 7,278,347 B1
(45) Date of Patent: Oct. 9, 2007

(54) SUBMARINE

(75) Inventors: Wolfgang Scharf, Hoisdorf (DE); Joachim Reuter, Mönkeberg (DE); Rolf Körver, Georgen (DE)

(73) Assignees: Howaldtswerke-Deutsche Werft AG (DE); Gabler Maschinenbau GmbH (DE)

( * ) Notice: Subject to any disclaimer, the term of this patent is extended or adjusted under 35 U.S.C. 154(b) by 0 days.

(21) Appl. No.: 10/883,944

(22) Filed: Jul. 2, 2004

(30) Foreign Application Priority Data

Jul. 4, 2003 (DE) ..... 103 30 174

(51) Int. Cl.
*F41A 23/00* (2006.01)
*B63G 1/00* (2006.01)

(52) U.S. Cl. ..... 89/37.06; 89/5; 114/1; 114/5; 114/6; 114/316

(58) Field of Classification Search ..... 89/37.06, 89/5; 114/1, 316, 5, 6
See application file for complete search history.

(56) References Cited

U.S. PATENT DOCUMENTS 731,500 A * 6/1903 Ridgway ..... 114/339
903,324 A * 11/1908 Schneider ..... 89/37.06
1,093,504 A 4/1914 Völler
1,095,049 A 4/1914 Völler
1,170,577 A 2/1916 Halsey
1,270,164 A * 6/1918 Johannessen et al. ..... 114/316
1,296,688 A * 3/1919 Noah ..... 114/6
1,356,294 A * 10/1920 Kuhajda ..... 89/38
4,164,890 A * 8/1979 Elmore et al. ..... 89/185
4,553,493 A * 11/1985 Sadler et al. ..... 114/1
5,677,506 A 10/1997 Wallin
5,911,172 A * 6/1999 Korolenko ..... 89/5
6,408,763 B1 * 6/2002 Hurtta et al. ..... 102/404

FOREIGN PATENT DOCUMENTS

GB 217218 2/1925

* cited by examiner

*Primary Examiner*—Michelle Clement
(74) *Attorney, Agent, or Firm*—McGlew and Tuttle P.C.

(57) ABSTRACT

A submarine is equipped with an extending apparatus on whose free end a container (4) resistant to underwater pressure is arranged, in which an essentially recoil-free gun (5) lies. The container (4) in the submerged condition of the submarine may be brought to the water surface (15) by way of the extending apparatus, and pivoted out so that one may also shoot in the submerged condition.

20 Claims, 2 Drawing Sheets

SUBMARINE

CROSS REFERENCE TO RELATED APPLICATIONS

This application claims the benefit of priority under 35 U.S.C. § 119 of German patent application DE 103 30 174.7 filed Jul. 4, 2003 the entire contents of which are incorporated herein by reference.

FIELD OF THE INVENTION

The invention relates to submarines, in particular for the military field.

BACKGROUND OF THE INVENTION

Submarines of this type usually consist of an essentially cylindrical pressure hull as well as one or more extending apparatus, for example in the form of a periscope, an aerial mast, or likewise which are arranged in the region of the tower and serve for accessing regions above the surface of the water in the submerged condition.

Military submarines are first and foremost designed for combating marine vessels and for this purpose usually comprise torpedoes as weapons. In particular with large, atomic-powered submarines it is counted as belonging to the state of the art to provide so-called launch shafts from which weapons in the form of missiles may be started for combating ground targets (U.S. Pat. No. 5,677,506).

It is further counted as belonging to the state of the art to provide a machine gun on the deck of the submarine. This weapon may however only be applied in the surfaced condition, and in the submerged condition produces an unfavorable flow resistance, and is furthermore complicated with regard to its design since all components of the weapon must be resistant to sea water and must be deigned in pressure-resistant manner.

The submarine-launched-air-missile for combating helicopters developed in Great Britain (SLAM for short) is much more favorable in this respect. Here, a missile launcher is arranged in a pressure-proof container and after the submarine has surfaced to such an extent that the tower region with the container comes out of the water, the container lid is opened and the missile launcher is extended on a mast out of the container. Disregarding the fact that the submarine must always be brought into the semi-submerged condition for this purpose, the missile launcher has the disadvantage that on the one hand the weapons launched with this have a very high destruction force and on the other hand are very sophisticated and expensive so that it is not suitable for tactical purposes such as for stopping commercial ships or for seizing pirate ships.

Modern submarines today thus only have weapons which may be applied against targets of middle to long range. Here it is the case of missiles and torpedoes which create extreme damage to the targets if they don't completely destroy these.

These weapons, for tactical as well as economic reasons may not be used against smaller, slightly armed marine vessels as would be required in order to have an influence in the required manner, be it to stop them, to force them to turn back or to initiate a search. The combating of land targets in coastal regions may also not be effected from these submarines.

BRIEF SUMMARY OF THE INVENTION

Against this background, it is the object of the present invention to design a submarine such that the previously mentioned targets may also be combated in a targeted manner preferably in the submerged condition.

According to the invention a submarine is provided with at least one extending apparatus. On a free end of the extending apparatus a container is provided. The container is resistant to underwater pressure. An essentially recoil-free gun is arranged in the container.

The basic concept of the present invention is to equip the submarine with a gun, but however to arranged this gun on an extending apparatus in order in this manner to also be able to combat on sea, land or in the air in a targeted manner. Since a recoil is produced with conventional guns having a projectile size range of about 10 to 40 mm diameter of interest here, and this recoil, given a required extended height of five meters for example, would demand an extremely extensive design of the extending apparatus in order to accommodate the recoil, i.e. in order to transmit the force via the extending apparatus to the submarine in a manner such that the weapon remains directed on the target, according to the invention, an essentially recoil-free gun is provided. Moreover, according to the invention, a container resistant to the underwater pressure is provided in which the weapon lies protected from external influences, in particular seawater, during submerged travel. By way of this it is possible to apply a modern recoil-free gun as has typically been developed for application on land and is available comparatively inexpensively on the market. On account of the solution according to the invention, it thus becomes possible to provide additional weaponry for the submarine which is highly effective for the previously mentioned tasks, at a relatively low cost, and which may be used without the submarine having to surface.

The extending apparatus carrying the container is advantageously arranged in the tower region, and specifically preferably as a bridge apparatus, thus as an extending apparatus which does not retract into the pressure hull. This is favorable with regard to the design since the complete weapons system is thus arranged outside the pressure hull and in this context neither safety precautions, nor special precautions with regard to the pressure need to be made. The arrangement in the tower region is particularly advantageous since the extending apparatus lies protected by the casing of the tower in a streamlined manner, and where appropriate may replace an existing extending apparatus, or may be provided additionally to this, for example by way of incorporating a submarine body section, in order to retrofit this and where appropriate further extending apparatus into an existing submarine.

A machine canon is preferably provided as a gun, which is capable of successively firing several rounds. Here, preferably a recoil-free weapons system such as for example a machine canon of the type RMK 30 of the Mauser factory Oberndorf Waffensystem GmbH, or a variant suitably modified for the mentioned application purpose. Such a machine canon is practically recoil-free and the required caseless ammunition may be supplied in an automated manner so that a reliable operation is ensured even in the submerged condition when only the container is located above the surface of the water. For this, the gun is usefully integrated into the water conduit system of the submarine. At the same time separate targeting apparatus may be provided for the gun, and this targeting apparatus may usefully likewise be arranged within the container next to the weapon and then connected to the weapons guidance system of the submarine. The caliber of such a weapon is adapted according to its task and advantageously lies between 10 and 40 mm.

The extending apparatus for the container comprises at least 1, preferably 2 or more guide profiles on which the container may be traveled. Advantageously the container is arranged in a traveling manner on two or three guide profiles which are round in cross section. The traveling movement at the same time is effected via at least one travel cylinder which is fastened to the pressure container, preferably next to this, in order in this manner to achieve an as large as possible extending length.

Where appropriate, a telescopically designed extending apparatus may be used for achieving an even larger extending length.

In order to be able to control the extension and retraction of the extending apparatus as well as the extension and retraction of the weapon from and into the container respectively, as well as the pivoting and actuation of the weapon in the submerged condition, it is necessary to provide suitable control means which may be operated from within the pressure hull.

The container which accommodates the gun from the outside, in its simplest form, may be designed such that the weapon is aligned together with the container and is ready for use after opening the container. It is however more favorable with regard to design to design the weapon such that it may be extended out of the container and to align it in the known manner after it has been extended. For this, suitable components may then be applied as are known for aligning weapons on land. At the same time the extension and retraction of the weapon from the container may be effected on the one hand by a guide and on the other hand by way of a linear drive, in particular a hydraulic cylinder. If no separate guide profile is provided but the inner wall of the container serves as a guide, one then saves space and costs. The container at the same time is preferably cylindrical, wherein the cylinder axis is arranged perpendicular to the longitudinal axis of the pressure hull and the upper end wall (face) of the container is designed as a lid. Thus after opening the lid, the weapon may be extended upwards out of the cylinder body.

As long as the extending apparatus with the pressure container located therein has been retracted, it lies protected within the tower casing. According to a further formation of the invention, in order to obtain an as favorable as possible flow profile so as to achieve an as low as possible disturbance of the penetrated water surface, and to additionally protect the extending apparatus to the outside, a streamlined profile section is provided which surrounds the container and the part of the extending apparatus located below this, inasmuch as this extends beyond the tower. This profile section is preferably designed as a tube profile section and is formed in a streamline manner and has a drop-like cross section for example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The invention is hereinafter explained in more detail by way of one embodiment example shown in the drawing. In the drawings.

DESCRIPTION OF THE PREFERRED EMBODIMENT

Figure 1:
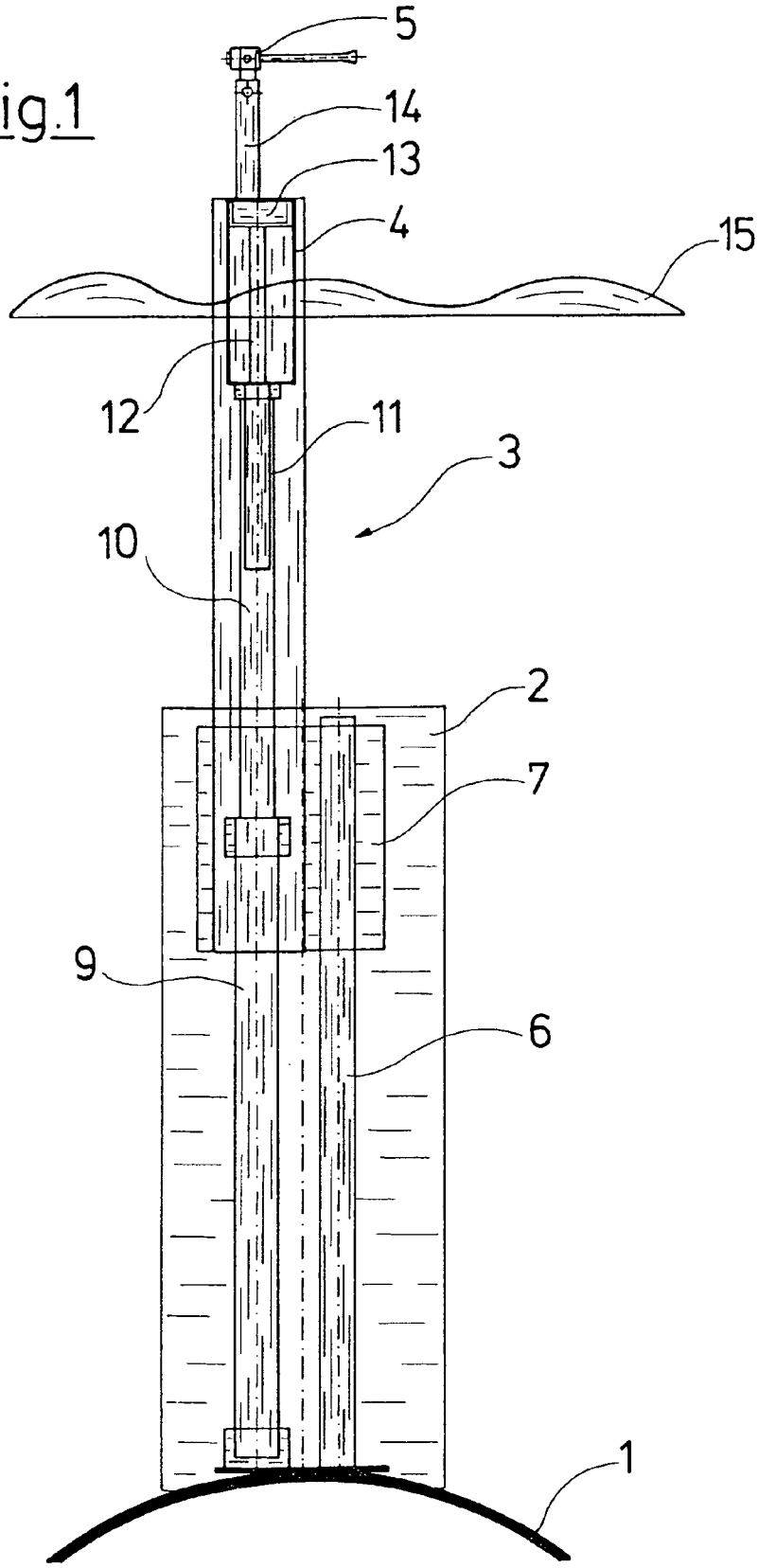
FIG. 1 is a greatly simplified schematic representation of the arrangement of the extending apparatus according to the invention on a submarine, shown in the submerged condition.

In FIG. 1 a pressure hull 1 of a submarine known per se is schematically shown in its upper region. In the middle region of this submarine a tower 2 joins this cylindrical pressure hull 1 at the top, in which the access shaft, a snorkel mast, periscopes as well as extending apparatus are arranged in a manner known per se and which are not shown in detail in the figure. The additional extending apparatus 3 according to the invention which carries a container 4 resistant to underwater pressure at it free upper end, in which a machine canon 5 is mounted in an extendable and pivotal manner, is however shown.

The extending apparatus 3 is designed as a bridge apparatus, thus is not designed to retract into the pressure hull 1. It comprises two guide profiles 6 which are round in cross section and on which a travel platform 7 is guided in a traveling manner. The travel platform 7 carries a tubular profile section 8 in whose upper end the container 4 is incorporated. The profile section 8 is designed in a streamline manner and surrounds that part of the extending apparatus 3 which in the extended position (FIG. 1) projects upwards beyond the tower 2. The profile section 8 close to its upper end is connected to the container 4 as well as to the upper end of a travel cylinder 9, in particular to the piston rod 10 of this dually acting hydraulic travel cylinder 9. The actual cylinder lies within the tower 2. If the piston rod 10 is completely retracted in this cylinder, the upper end of the profile section 8 is likewise located within the inner contour of the tower 2.

The container 4 is designed in an essentially cylindrical manner. The axis of the cylinder lies parallel to the axis of the travel cylinder 9 and perpendicular to the longitudinal axis of the pressure hull 1. The container 4 at its upper side comprises a lid which may be pivoted open (not shown). After opening the lid, the machine canon 5 located within the container 4 may be extended. For this, a second travel cylinder 11 is provided which in the same manner as the travel cylinder 9 acts in a dual manner and may be hydraulically actuated. The piston rod 12 of the travel cylinder 11 carries a guide platform 13 which is guided in a vertically traveling manner within the cylindrical inner wall of the container 4. This guide platform 13 carries a mount 14 on which the machine canon 5 is pivotally fastened. In the retracted condition, the machine canon 5 lies with its barrel parallel to the mount 14. When the guide platform 13 is extended up to near the upper end of the container 4 by way of the travel cylinder the machine canon articulated onto the upper end of the mount 14 may be pivoted by about 90 degrees, so that this assumes its operational position shown in FIG. 1. The pivoting-out of the machine canon 5 may be effected electromotorically or hydraulically. The machine canon 5 itself, in the manner known per se, may arranged to the mount 14 in a rotational as well as alignable manner, these targeting movements are effected in a motor-controlled manner. A targeting apparatus which here is not shown is also attached to the machine canon 5, which is data-connected to the on-board weapons guidance system. The machine canon 5 as well as the units which are connected to this communicate with this system and are controlled from within the pressure hull 1.

Figure 2:
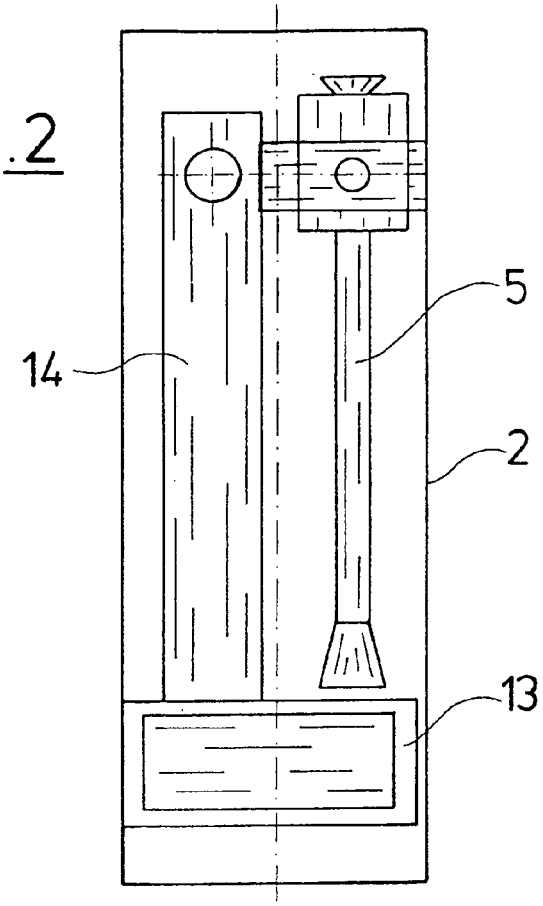
FIG. 2 is an enlarged schematic representation of the arrangement of the weapon within the container.
Figure 3:
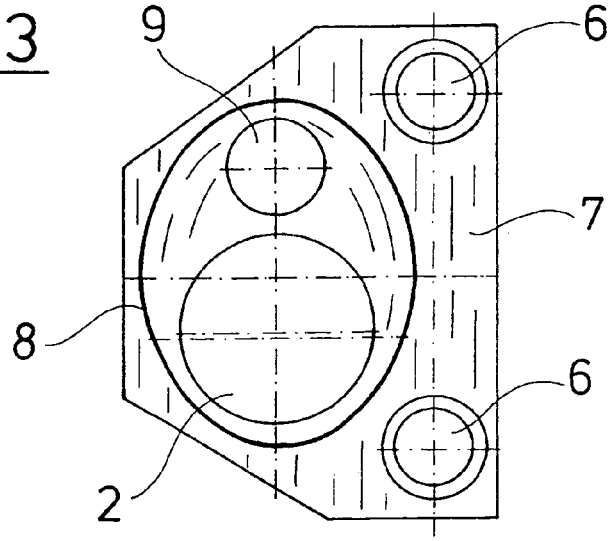
FIG. 3 is a cross sectional view through the extending apparatus and container.

With submerged travel, the machine canon 5 is completely retracted in the container as is shown in FIG. 2. The container lid is closed in a pressure-tight manner so that with submerged travel, the machine canon 5 with the associated targeting apparatus lies protected within the container 2 irrespective of the submerged depth. The extending apparatus 3 is then retracted so that it lies completely within the outer contour of the tower 2.

For activating the machine canon 5, the submarine is to be surfaced until shortly below the water surface 15, whereupon the extending apparatus 3 by way of a suitable impingement of pressure of the travel cylinder 9 is extended to such an extent that at least the upper part of the container 4 penetrates the water surface 15 and is located at a distance to this. The container lid is then opened and the travel cylinder 11 is impinged with pressure such that it extends, by which means the mount 14 with the machine canon 5 which is still arranged parallel to this on the guide platform 13 is extended upwards. As soon as the upper end position has been reached, the machine canon 5 is pivoted by 90 degrees and is locked in this position. The machine canon 5 may then be pivoted about the axis of the mount 14 as well as also transversely to this by way of the guns own alignment, in order to target targets at sea, in the air and on land. Since the machine canon 5 functions in a largely recoil-free manner, one achieves a very high hit accuracy, so that as a rule one requires fewer rounds in order to hit the desired target. In a reverse sequence the machine gun 5 and then the extending apparatus 3 are retracted by way of opposite pressure impingement of the travel cylinder 11 and 9.

In the surfaced condition the extending apparatus 3 does not have to be completely extended and it may be sufficient to extend the machine canon 5 with a retracted extending apparatus 3 or however the extending apparatus is extended by a suitable small distance, depending on the arrangement and design of the adjacent extending apparatus.

The hydraulic supply of the travel cylinder 11 is effected via the travel cylinder 9 so that one may do away with laying conduits.

While a specific embodiment of the invention has been shown and described in detail to illustrate the application of the principles of the invention, it will be understood that the invention may be embodied otherwise without departing from such principles.

APPENDIX

List of Reference Numerals

1—pressure hull
2—tower
3—extending apparatus
4—container
5—machine canon
6—guide profile
7—travel platform
8—profile section
9—travel cylinder
10—piston rod
11—travel cylinder
12—piston rod
13—guide platform
14—mount
15—water surface

What is claimed is:

1. A submarine comprising:

a submarine pressure hull;

an extending apparatus connected to said submarine pressure hull and having a telescopically operated free end movably extendable with respect to said pressure hull;

a tower connected to said pressure hull, said tower extending outside said submarine pressure hull;

a pressure container defining a closed volume protected from an external environment and resistant to underwater pressure, said pressure container being arranged on said free end, outside of said submarine pressure hull, said extending apparatus being arranged in said tower, said extending apparatus being protracted from said tower in a use position and retracted into said tower in an unused position, said extending apparatus being located outside said pressure hull; and an essentially recoil-free gun arranged in said pressure container, wherein said pressure container is openable to deploy said gun whereby said pressure container may be moved at least partially above a water line with said submarine pressure hull underwater allowing firing of said gun without surfacing said submarine pressure hull.

2. A submarine according to claim 1, further comprising:

at least one bridge apparatus, said extending apparatus being arranged in said tower region as said bridge apparatus, said tower having a tower region.

3. A submarine according to claim 1, wherein said gun is mounted to said pressure container to be pivotable for extension out of said container and pivoted out into an extended position.

4. A submarine according to claim 1, wherein said gun is a machine cannon.

5. A submarine according claim 1, wherein the gun is integrated into a weapons guidance system of the submarine.

6. A submarine according to claim 1, wherein the extending apparatus comprises at least one guide profile and a travel cylinder with hydraulically actuated piston rod.

7. A submarine according to claim 1, further comprising a control means for controlling an extension and a retraction of said extending apparatus, an alignment and an activation of a weapon, said control means being able to be operated from within said pressure hull.

8. A submarine according to claim 1, wherein the extending apparatus operates telescopically.

9. A submarine according to claim 1, wherein the container has an essentially cylindrical shape, wherein the cylinder axis is arranged perpendicular to a longitudinal axis of said pressure hull, and an upper end-wall or an end-face of the container forms a lid.

10. A submarine according to claim 1, wherein an inner wall of the container forms a guide for an extension and a retraction of the gun into and out of the container.

11. A submarine according to claim 1, wherein the container is arranged within a streamline profile section comprising a tube profile section which may be extended together with the container.

12. A submarine according to claim 11, wherein a profile section is designed and arranged in a manner such that said profile section encompasses a part of the extending apparatus extending beyond the tower, said tower having a tower region.

13. An extending arrangement for a submarine having a pressure hull with a closed hull volume, the extending arrangement comprising:

an extending apparatus rod with a telescopically operated free end that can be moved relative to the pressure hull;

a pressure container defining a closed volume separate from said closed hull volume protected from an external environment arranged at the free end of the extending apparatus rod;

a tower fixed to an outside of said pressure hull, said extending apparatus rod being located within said tower, outside said pressure hull, in a retracted position, said extending apparatus rod extending outside said tower to an extended position; and an essentially recoil-free gun arranged within said pressure container, said pressure container being openable to deploy said gun from a non-firing position to a firing position when said extending apparatus rod is in said extended position.

14. An extending apparatus according to claim 13, wherein said gun is pivotable for extension out of said container and pivoted out into an extended position.

15. An extending apparatus according to claim 13, wherein said gun is a machine cannon.

16. An extending apparatus according to claim 13, further comprising: at least one guide profile and a travel cylinder.

17. A submarine comprising:

a pressure hull;

a tower mounted to said pressure hull;

an extending apparatus with a top and a bottom, said extending apparatus being protractable from said pressure hull and being connected to said pressure hull and having a telescopically operated free end that can be moved relative to the pressure hull, said extending apparatus being mounted within said tower, said extending apparatus extending from a use position to an unused position;

a pressure container connected to or forming a part of said extending apparatus at said top, said container defining a space closed off from an external environment and resistant to pressure of the external environment and having a detachable upper end face defining a lid that is openable, said pressure container being outside of said pressure hull and said pressure container being moveable relative to said pressure hull, said extending apparatus extending said pressure container outside said tower in said use position, said extending apparatus retracting said pressure container within said tower in said unused position, said extending apparatus being located outside said pressure; and an essentially recoil-free gun protracting from said container through said lid in said use position and retracting into said space in said unused position.

18. A submarine according to claim 17, wherein:

an inner wall of the container forms a guide for an extension and a retraction of the gun into and out of the container;

said container is arranged within a streamline profile section comprising a tube profile section which may be extended together with said container; and said profile section is designed and arranged in a manner such that said profile section encompasses a part of the extending apparatus extending beyond said tower.

19. An extending apparatus according to claim 13, wherein the container has an essentially cylindrical shape, wherein the cylinder axis is arranged perpendicular to a longitudinal axis of a pressure hull, and the upper, end-wall or end-face of the container forms a lid.

20. An extending apparatus according to claim 13, wherein an inner wall of the container forms a guide for an extension and a retraction of the gun into and out of the container.

* * * * *

UNITED STATES PATENT AND TRADEMARK OFFICE

CERTIFICATE OF CORRECTION

PATENT NO. : 7,278,347 B1
APPLICATION NO. : 10/883944
DATED : October 9, 2007
INVENTOR(S) : Scharf et al.

It is certified that error appears in the above-identified patent and that said Letters Patent is hereby corrected as shown below:

On The Title Page, should read,

Item (73) Assignees: Howaldtswerke-Deutsche Werft GmbH (DE);
Gabler Maschinenbau GmbH (DE)

Signed and Sealed this

First Day of April, 2008

JON W. DUDAS
*Director of the United States Patent and Trademark Office*